US005438728A

United States Patent [19]

Kubes et al.

[11] Patent Number: 5,438,728

[45] Date of Patent: Aug. 8, 1995

[54] ROTARY BRUSH WITH SEGMENTED FIBER SECTIONS

[75] Inventors: Michael J. Kubes, Maplewood; Lawrence J. Mann, Lake; Elmo, both of Minn.; Jonathan E. Noble, Cambridge, Iowa

[73] Assignee: Minnesota Mining and Manufacturing Company, St. Paul, Minn.

[21] Appl. No.: 210,589

[22] Filed: Mar. 18, 1994

[51] Int. Cl.[6] ..... A46B 1/00; A46B 7/08; A46B 9/02

[52] U.S. Cl. ..... 15/180; 15/49.1; 15/186

[58] Field of Search ..... 15/180, 186, 187, 188, 15/198, 49.1, 50.1, 87, 385

[56] References Cited

U.S. PATENT DOCUMENTS

| | | | |
|---|---|---|---|
| 1,641,103 | 8/1927 | Small | 15/198 |
| 2,153,207 | 4/1939 | Petty | 15/180 |
| 2,281,278 | 4/1942 | Finnell | 15/186 |
| 2,480,739 | 8/1949 | Johnson | 15/93 |
| 3,233,272 | 2/1966 | Pambello | 15/182 |
| 3,243,832 | 4/1966 | Allen et al. | 15/180 |
| 3,290,713 | 12/1966 | Barry | 15/180 |
| 3,381,326 | 5/1968 | Dolan et al. | 15/180 |
| 3,398,422 | 8/1968 | Barry et al. | 15/180 |
| 3,436,245 | 4/1969 | Grundman | 25/117 |
| 3,526,919 | 9/1970 | Byers | 15/180 |
| 3,527,001 | 9/1970 | Kleemeier | 51/358 |
| 3,529,945 | 9/1970 | Charvat | 15/295 |
| 3,605,347 | 9/1971 | Barry | 15/180 |
| 3,616,126 | 10/1971 | Tungseth | 53/161 |
| 3,943,594 | 3/1976 | Alvin | 15/180 |
| 4,114,225 | 9/1978 | Malish | 15/230 |
| 4,236,269 | 12/1980 | Block | 15/180 |
| 4,322,920 | 4/1982 | Wells | 15/180 |
| 4,627,127 | 12/1986 | Dupre | 15/179 |
| 4,907,313 | 3/1990 | Roeker et al. | 15/98 |
| 5,016,311 | 5/1991 | Young et al. | 15/88.3 |
| 5,050,262 | 9/1991 | Malish | 15/180 |
| 5,083,840 | 1/1992 | Young et al. | 21/300 |
| 5,233,719 | 8/1993 | Young et al. | 15/179 |
| 5,233,794 | 8/1993 | Kikutani et al. | 51/206 |
| 5,243,727 | 9/1993 | Tanaka et al. | 15/180 |
| 5,289,605 | 3/1994 | Armbruster | 15/180 |

FOREIGN PATENT DOCUMENTS

| | | | |
|---|---|---|---|
| 2365935 | 5/1978 | France | 15/180 |
| 12747 | 6/1906 | United Kingdom | 15/49.1 |
| 2165742 | 9/1985 | United Kingdom . | |

*Primary Examiner*—Edward L. Roberts, Jr.
*Attorney, Agent, or Firm*—Kinney & Lange

[57] ABSTRACT

A rotary brush assembly for treating a surface has a circular disk having a generally flat first side and a second side. A plurality of elongated fibers are individually attached to the first side of the disk and positioned generally parallel to one another and perpendicular to the first side of the disk. The unattached ends of the fibers collectively define a generally planar treatment surface adjacent and generally parallel to the first side of the disk. The fibers are positioned such that the fibers form areas of filled space on the treatment surface, the areas of filled space separated by areas without fibers.

17 Claims, 4 Drawing Sheets

ROTARY BRUSH WITH SEGMENTED FIBER SECTIONS

BACKGROUND OF THE INVENTION

The present invention relates to brushes, and specifically to brushes which are primarily adapted for uses such as scrubbing, stripping, polishing or buffing a surface. A particular application relates to brushes for use on floor maintenance machines of the type used in commercial, institutional and industrial floor maintenance applications. In such machines, one or more cleaning brushes or pads are attached to the machine and rotated by the machine to perform the desired maintenance operation.

A wide variety of machines are presently available for scrubbing, stripping, polishing or buffing a surface, and many of the surface treatment machines are adaptable to provide any combination of the above treatments when provided with the appropriate types of brushes. Therefore, any particular surface treatment machine may be used with several types of brushes, with the type of brush varying with the desired surface treatment. Because of the variety of possible applications for brushes used on surface treatment machines, a large number of brushes are often kept in stock by the user. The brushes are typically changed at frequent intervals, either to replace a worn brush or to provide a different surface treatment. Replacement of worn brushes is an especially important factor in commercial situations because commercial surface treatment machines are used to perform a variety of surface treatments. The versatility of many surface treatment machines thus requires that brushes be easily replaced or substituted, either when switching from one type of surface treatment to another, or when replacing a worn brush.

Previously, brushes used on surface maintenance machines have included a relatively rigid and heavy support disk to which the brush bristles are mounted. The brush bristles are fixed to the disk by inserting a bundle of bristles forming a loop into a blind or throughhole provided in the support disk, and the bundle of bristles is fixed to the disk by means of nails, staples, pins or stitching. The brush bristles are typically arranged to cover the full face of the brush, often leaving only the central portion of the brush face free of bristles.

The support disks to which the brush bristles are fixed are typically adapted to be detachably secured on a mounting member which, in turn, is adapted to be mounted on a surface maintenance machine. Prior arrangements have generally included the use of various nut and bolt or bracket plate fastening systems. Such attachment means typically require inversion of the surface treatment machine to replace or remove a brush, making brush replacement difficult. Additionally, a wide variety of attachment means are used by brush manufacturers, so the mounting member (attached to the treatment machine) must often also be changed when changing to a different type of brush. Finally, the support disk and attachment means are often shaped such that the brush assemblies are difficult to store. For example, the brush assemblies are not easily stacked upon one another, and they are large and require a large storage area.

A need thus exists for a brush assembly which may be adapted to provide a variety of surface treatments when used with a surface treatment machine and particularly when treating uneven surfaces. There is also a need for a brush assembly which is easily interchangeable with other brushes on the surface treatment machine. Preferably the brush assembly also weighs less and is easier to store than currently available brush assemblies.

SUMMARY OF THE INVENTION

The present invention is a brush assembly for use with surface treatment machines. The brush assembly provides a treatment efficiency for uneven surfaces comparable to currently available brushes while being constructed of less material. The more efficient use of material produces a brush assembly which also weighs less than currently available brushes. The brush assembly is easily interchanged with another brush assembly on a surface treatment machine, and the configuration of the brush assembly allows easy storage.

The present invention comprises a circular disk or plate with a central rotary axis, the disk or plate having a generally fiat first side and a second side. Each of a plurality of elongated fibers is individually attached to the first side of the disk. The fibers are generally aligned parallel to one another and generally perpendicular to the first side of the disk. The unattached ends of the each of the elongated fibers collectively define a generally planar treatment surface adjacent and generally parallel to the first side of the disk. The fibers are preferably positioned such that the unattached ends of the fibers (defining the generally planar treatment surface) form areas of filled space on the treatment surface, the areas of filled space separated by open areas on the treatment surface. The pattern of fibers thus forms a segmented treatment surface.

The second side of the disk may include attachment means to attach the brush assembly to a surface treatment machine. Preferably, the attachment means comprises a hook and loop type fastener, with one material of the hook and loop type fastener attached to the second side of the disk, and the mating material of the hook and loop type fastener adapted for attachment to a mounting surface which is secured to a surface treatment machine.

The segmented treatment surface in combination with the generally parallel fibers creates a series of "edges" which allow the fibers to reach recesses in an uneven surface, thus providing a treatment efficiency greater than a similar brush assembly without a segmented treatment surface. The segmented treatment surface also aids in reducing the amount of material which accumulates in the fibers of the brush. The open areas on the treatment surface provide space for material to accumulate and thereby lengthen the service life of the brush. The present invention also results in a brush assembly which uses less material and is lighter than currently used brushes assemblies. Further, the use of less material to form the brush is expected to reduce the cost of the brush. The lower cost allows a larger number and greater variety of brushes to be maintained in inventory by a user, and the relatively flat shape of the brush assembly increases ease of storage and handling. The hook and loop type attachment means, if employed, eases the interchange of brushes when replacing worn brushes or switching to a different surface treatment.

While the above-identified drawing figures set forth preferred embodiments of the invention, other embodiments are also contemplated, as noted in the discussion. In all cases, this disclosure presents the present invention by way of representation and not imitation. It should be understood that numerous other modifications and embodiments can be devised by those skilled in the art which fall within the scope and sphere of the principles of this invention.

DETAILED DESCRIPTION OF THE PREFERRED EMBODIMENTS

The present invention is a brush assembly for use with surface treatment machines adapted to use a rotary brush. The description herein is directed to the use of brush assemblies on floor maintenance machines. However, it is contemplated that the inventive apparatus is useful in connection with the efficient and effective treatment of other surfaces when used with other types of surface treatment machines.

Figure 1:
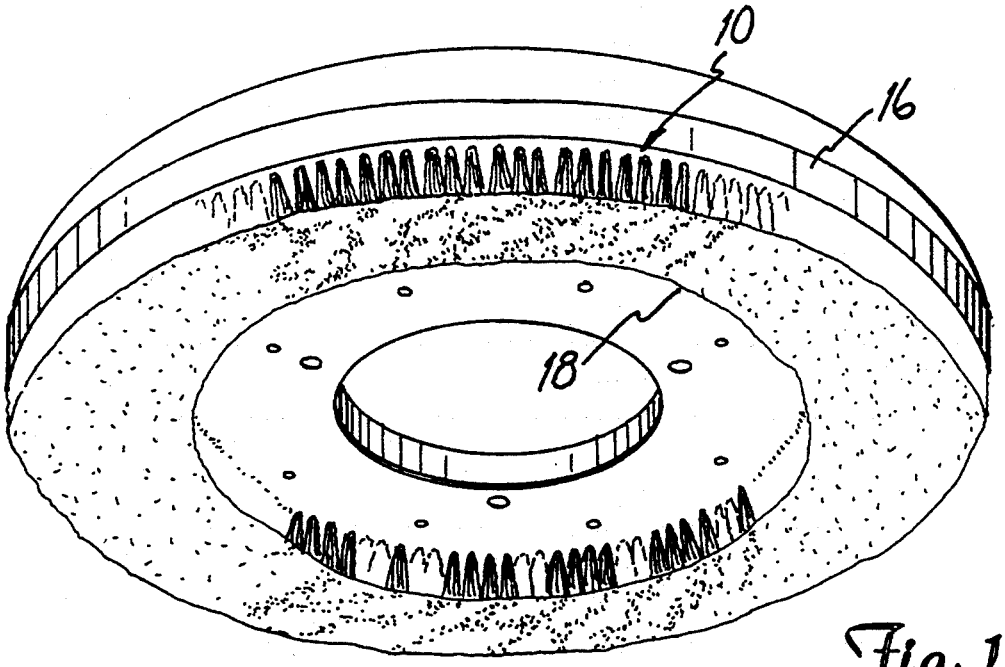
Fig. 1 PRIOR ART
FIG. 1 is a perspective view of a brush assembly representative of currently available brush assemblies.
Figure 2:
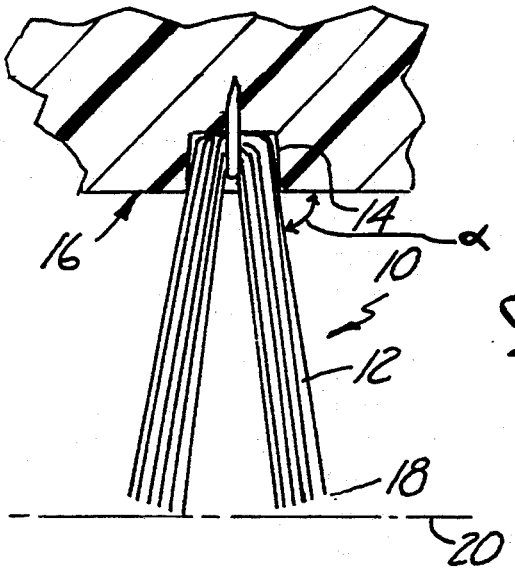
Fig. 2 PRIOR ART
FIG. 2 is an enlarged sectional end view of a brush assembly representative of currently available brush assemblies.

Prior art rotary brush assemblies, as illustrated in FIGS. 1 and 2, typically utilize individual tufts 10 of bristles 12 which are stapled or stitched into blind or through-holes 14 in a rigid support base 16 which is typically formed of wood, metal, or a heavy polymeric material. A variety of other attachment methods are used and include inserting bundles of bristles through holes in the base and clamping the bundles in place and mounting previously assembled strips of brush material on the support base. It can be seen that prior art rotary brush assemblies often utilize relatively complex and expensive methods for attaching bristles to the support base. In contrast, the preferred rotary brush assembly of the present invention is formed as a single unit, thereby greatly simplifying the construction process, producing a lightweight brush assembly and reducing the cost of constructing the brush assembly.

In the prior art assembly illustrated in FIGS. 1 and 2, the secured tufts 10 of bristles 12 typically assume a generally splayed configuration. As the bristles 12 extend from the support base 16, the ends 18 of the bristles 12 from each tuft 10 approach the ends 18 of bristles 12 from adjacent tufts 10. The converging bristles 12 thus form a generally planar treatment surface 20-parallel and adjacent to the support base 16. The planar treatment surface 20 formed by the ends 18 of the bristles 12 is generally completely filled, as illustrated in FIG. 1, except for the central area of the treatment surface which is generally free of bristles to allow the brush assembly to be secured to the surface treatment machine. Depending upon the brush construction, some additional areas of the treatment surface 20 may also be left open (i.e., without bristle sections). For example, U.S. Pat. No. 3,243,832 discloses a rotary brush in which replaceable strips of bristles are inserted into spaced apart channels which leave open spaces between the strips of bristles. Similarly, U.S. Pat. No. 4,236,269 discloses strips of bristles which are attached to a support base in a U-shaped configuration, and which leave some open spaces between the bristle strips. However, the open areas on the treatment surface of the above referenced patents are a result of the construction method (i.e., replaceable strips of brush material mounted to the support base), and the patents do not teach the use of a segmented treatment surface to obtain an improved treatment efficiency.

Figure 3:
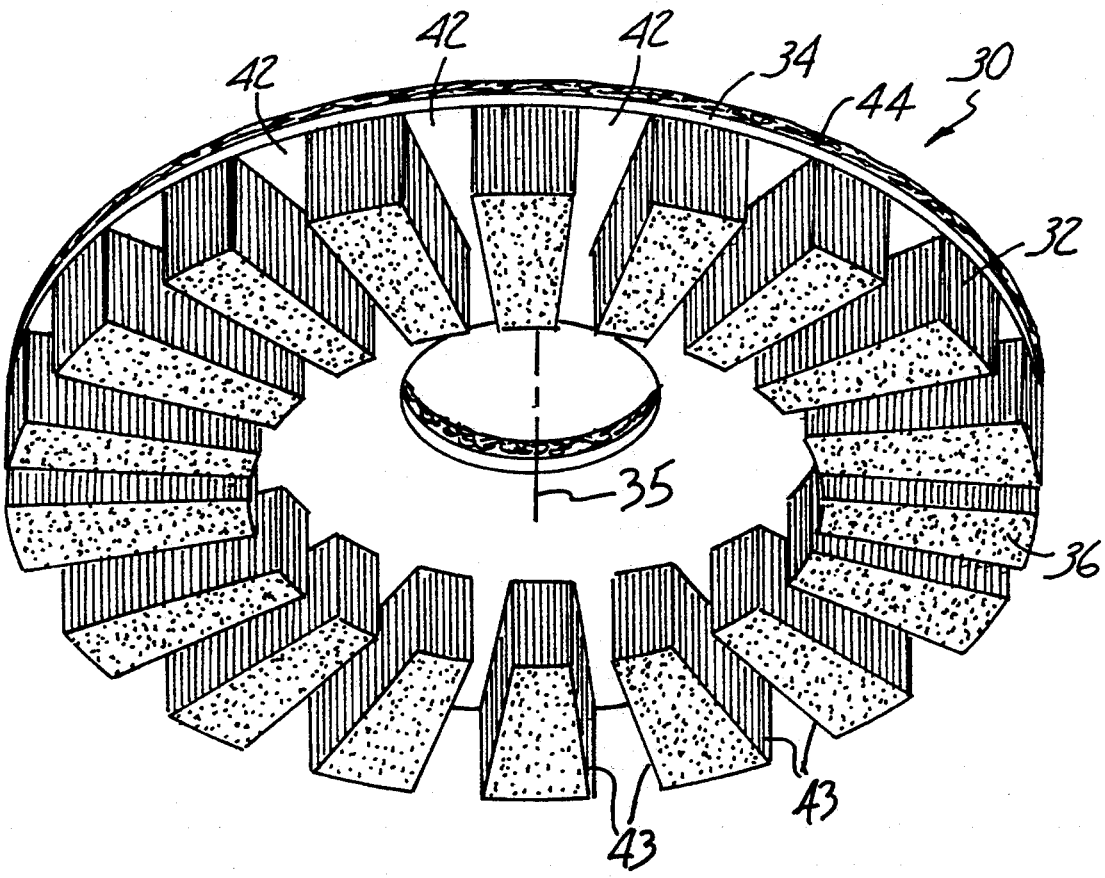
FIG. 3 is a perspective view of the brush assembly of the present invention.
Figure 4:
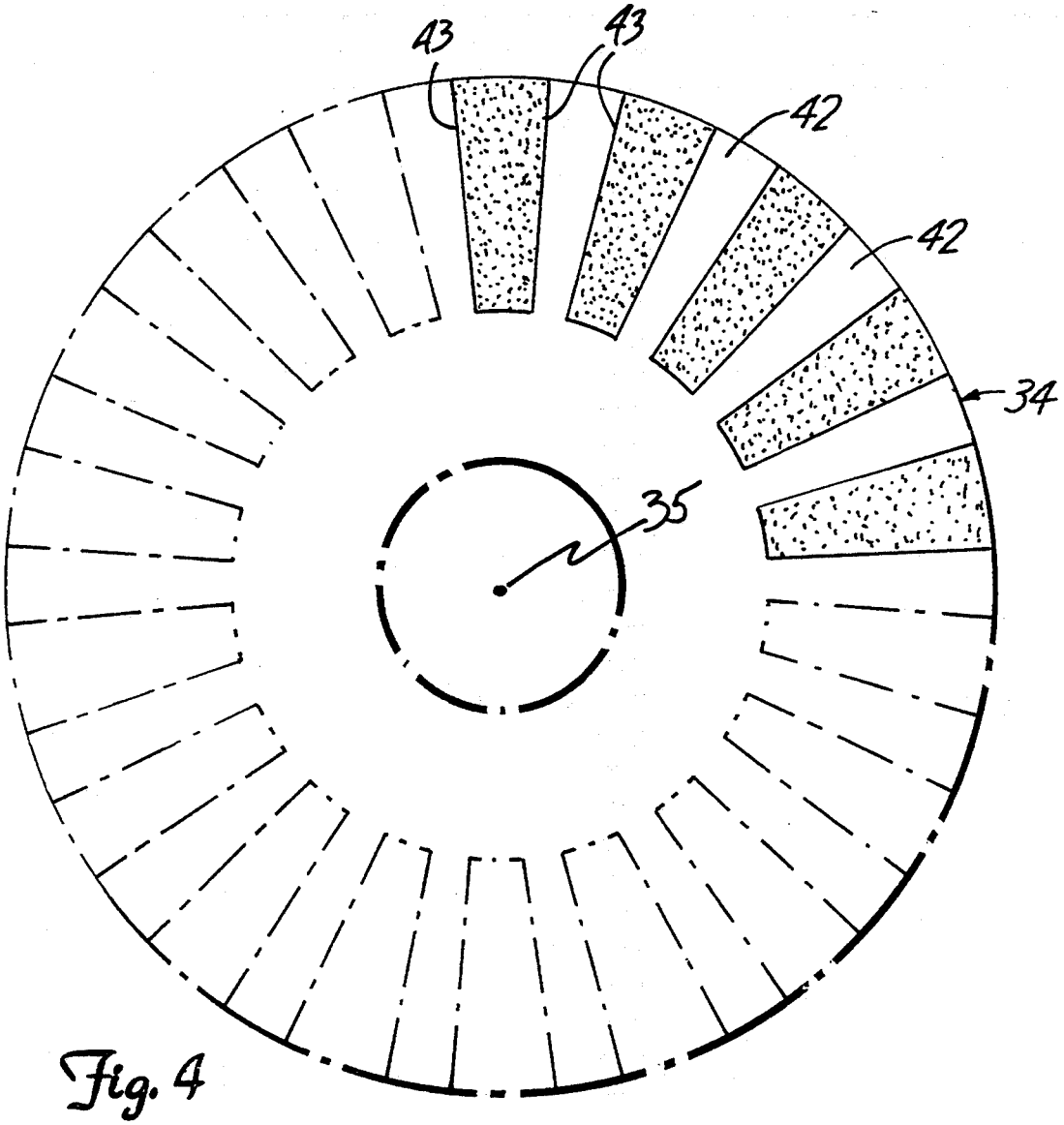
FIG. 4 is a bottom elevational view of the brush assembly of the present invention.
Figure 5:
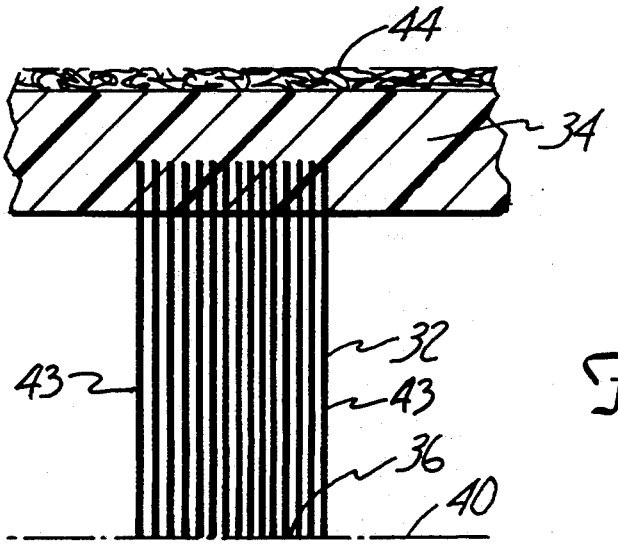
FIG. 5 is an enlarged sectional end view of the brush assembly of the present invention.

As illustrated in FIGS. 3–5, a rotary brush assembly 30 of the present invention provides a plurality of filaments or fibers 32 embedded in a support disk 34 with a central rotary axis 35. Preferably the support disk 34 is flexible. The fibers 32 are generally densely packed and positioned parallel to one another and perpendicular to the support disk 34. The free ends 36 of the fibers 32 define a generally planar treatment surface 40 which is adjacent and parallel to the support disk 34. The treatment surface 40 defined by the free ends 36 of the fibers 32 is generally annular in shape. The treatment surface 40 includes open segments 42, which create a "patterned" or segmented treatment surface 40. (See FIG. 5).

Figure 7:
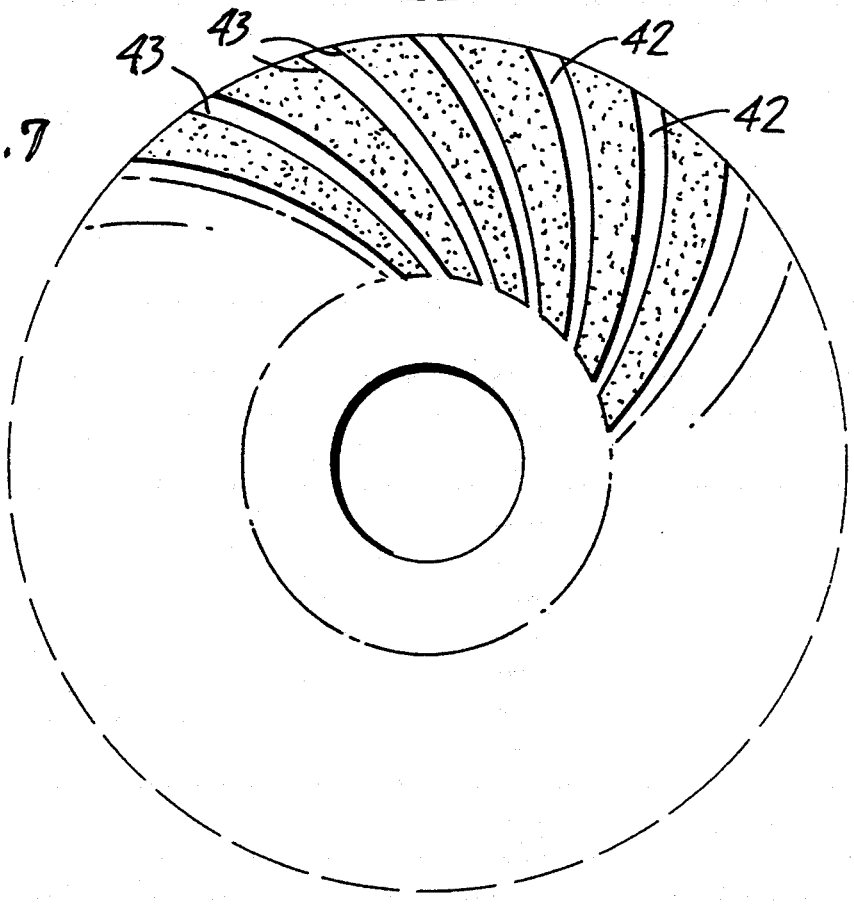
FIG. 7 is a bottom elevational view of the brush assembly of the present invention illustrating yet another alternative bristle pattern.

It has been determined that providing open segments 42 (i.e., without fibers 32) on the treatment surface 40 provides an improved treatment efficiency for the brush assembly 30 when the fibers 32 are positioned in parallel relation to each other and individually embedded in the support disk 34, as described above and illustrated in FIGS. 3–5. It is believed that the depicted alignment of fibers 32 allows the ends 36 of the fibers 32 to act upon a surface to be treated, rather than allowing the fibers to bend and consequently act upon the surface to be treated with the sides of the fibers. Further, uniform length of the fibers 32, as seen in FIG. 5, allows the ends 36 of the fibers 32 to act simultaneously on the surface to be treated. In contrast, conventional brush assemblies (e.g., such as shown in FIGS. 1–2) utilize tufts of bristles 12 which are not densely packed and which have a splayed or inclined fiber or inclined fiber configuration. The splayed or inclined bristles 12 of prior art brush assemblies form an angle $\alpha$ with the support disk 16. The splayed or inclined configuration of the prior an increases the tendency of the fibers to bend and thereby reduces the ability of the ends 18 of the bristles 12 to act upon the surface to be treated. As seen in FIG. 2, the splayed or inclined configuration of the prior art also prevents the ends 18 of the bristles 12 from acting upon the surface to be treated in a simultaneous manner. It is believed the open segments 42 defined by the present invention create a series of edges 43 of fiber ends 36 which allow the fibers 32 to more successfully reach recesses found in uneven surfaces, thereby improving cleaning efficiency. In FIG. 4, the edges 43 extend radially outwardly, thus forming wedge-shaped segments of fibers 32. However, it is contemplated that the segments defined by the edges 43 may have other shapes. For example, as seen in FIG. 7, the edges 43 may extend spirally from the center of the support disk 34, thus defining spiral-shaped segments of fibers 32.

The reduced number of fibers 32 also results in an increased pressure on the remaining fibers 32. The remaining fibers 32 must each support a greater force, and the resultant increase in pressure at the ends 36 of the fibers 32 further aids in improving the treatment efficiency of the inventive brush assembly. To maximize the ability of the ends 36 of the fibers 32 to act upon the surface to be treated, it is important that the fibers 32 are generally perpendicular to the support disk 34. By keeping the fibers 32 generally perpendicular to the support disk 34, the tendency of the fibers 32 to bend is reduced and pressure can be maintained on the ends 36 of the fibers 32. However, it is further believed that a patterned or segmented treatment surface will improve the treatment efficiency of brushes with fiber alignments other than that depicted in FIG. 5, provided the fiber alignment allows the ends of the fibers to act upon the surface.

Finally, when used in applications such as stripping a surface, a rotary brush assembly removes some amount of material from the surface being treated. The material which is removed from the surface often accumulates in the fibers of the brush and reduces both the performance and service life of the brushes for the prior art. The open segments 42 of the brush assembly of the present invention provide either space for material to accumulate in the brush, or alternatively provide a channel to expel material from the brush when used in operations where material build-up occurs. The inventive brush assembly thereby reduces the effect of material build-up in the brush fibers and lengthens the service life of the brush assembly.

To obtain the brush construction described in FIGS. 3–5, the fibers 32 are embedded and attached to the support disk 34 using a flock coating method such as that disclosed in U.S. Pat. No. 3,436,245 to Grundman and U.S. Pat. No. 3,527,001 to Kleemeier, both of which are herein incorporated by reference. The fibers 32 are typically composed of a polymeric material, and additionally may include abrasive particles, depending upon the desired application of the brush assembly. The support disk 34 is also typically composed of a polymeric material, with the material of the support disk 34 cooperating with the material of the fibers 32 to securely hold the fibers 32 to the support disk 34. Flock coating as described in U.S. Pat. No. 3,436,245 and U.S. Pat. No. 3,527,001 provides a method whereby a vibration-type flock coating can be applied to a substrate in which practically all of the adhered flock fibers are generally perpendicular with the backing material, thus making possible a significant savings in the cost of the articles. The fact that most of the fibers are adhered generally perpendicular to the backing material and parallel to each other makes possible higher productions rates because of the tendency of the adhered fibers to guide additional unadhered fibers into position. The method of flock coating also provides the ability to apply flock in distinct patterns. The method also makes it possible to control the flock density.

To produce the structure of the present invention, the adhesive surface of a normally tacky and pressure sensitive adhesive sheet is laminated to a masking element. The masking element functions to prevent filament segments from embedding themselves in the masked portions of the adhesive surface. Open areas provided in the masking element determine the density and pattern of the filaments in the finished product. Therefore, the construction of the masking element is dictated by the desired design of the final product. For example, a glass scrim cloth may be used as the masking element to produce an even density of fibers across the surface, or alternatively a foam material, for example, with desired patterns cut into the material, could be used to produce any desired pattern of fibers across the surface of the adhesive sheet.

The adhesive/mask laminate is then passed through a flocking station. The laminate is passed over a taut fabric which is set in vibratory motion by suitable means, such as by rotation of one or more rectangular-shaped beater bars mounted under the width of the fabric. Beater bar operation causes the taut fabric and laminate thereon to bounce and vibrate in a vertical direction at a fairly high rate of speed. At the same time, the desired fiber segments are distributed on end across the vibrating laminate. The fiber segments may be distributed by mechanical means or by an operator dropping fibers onto the laminate. As the fibers fall onto the bouncing laminate, they tend to adhere and stand upright on the parts of the laminate that have exposed adhesive. The areas of the laminate that are covered with the masking element remain free of adhered fibers. As fibers continue to be distributed across the laminate surface, the fibers that are already standing on the adhesive tend to support additional fibers that are distributed onto the same area, thereby causing the fiber density to increase. Loose fibers are shaken free.

After the desired fiber pattern and density is achieved, the laminate and fibers adhered thereto are passed around a drum, thereby causing the fibers to bristle outward from the adhesive backing. As the laminate and adhered fibers pass around the drum, the flocked laminate becomes inverted, with the adhered fibers now hanging from and generally below the laminate. The exposed or free ends of the fibers are embedded in a layer of flexible resin which has previously been coated on a suitable carrier or substrate. The resin is then cured and the adhesive/mask laminate is then removed, and the ends of the fibers that were adhered to the laminate thus become the free ends of the fibers of the brush assembly. After curing, the resin and bonded fiber product may be cut to the desired shape to produce the finished product.

The carrier or substrate upon which the resin is coated preferably is (or is provided with) means for mounting the finished brush assembly for use. For example, the carrier may be one material of a hook and loop type fastener, with the mating material of the hook and loop type fastener adapted for attachment to a mounting surface which is secured to a surface treatment machine. One material of a hook and loop type fastener 44 is indicated in FIGS. 3 and 5. The carder may alternately, and by way of example, comprise a material of the type sold under the SCOTCH-MATE trademark and manufactured by Minnesota Mining and Manufacturing Company of St. Paul, Minn., or the carrier may be a suitable pressure sensitive adhesive. When the carrier or substrate includes such means for mounting the finished brush assembly, the resin which forms the support disk 34 is preferably flexible in its cured condition to aid in the mounting and removal of the brush assembly.

The brush of the present invention may also be constructed by applying adhesive in the desired pattern to a temporary backing material, thereby eliminating the need for using a masking element. The fibers are than distributed across the adhesive in the manner described above to cause the fibers to adhere to and stand on end in the patterned adhesive. This subassembly is then processed with the flexible resin as described above, the adhered backing material removed after the resin cures, and the resin and bonded fiber product further processed as described.

An additional method by which the brush of the present invention may be constructed is by a direct flocking process. In this alternative, a curable layer of flexible resin is applied in the desired pattern directly on a flexible backing. Fibers of the desired size are deposited onto the patterned resin by hand or mechanical means and then induced by suitable means (electrostatic or mechanical) to stand on end in the flexible resin. The resin is then cured to secure the fibers, and the cured composite is then brushed or suctioned to remove unbonded fibers. The composite may then be cut into the desired product shape.

Finally, the patterned rotary brush assembly of the present invention may be constructed by first making a non-patterned resin and bonded filament assembly in the manners described above, but by foregoing the use of a masking element or patterned application of adhesive or resin. In this latter instance, a non-patterned resin and bonded filament assembly is constructed, resulting in a brush construction similar to that sold under the DOODLEBUG trademark and manufactured by Minnesota Mining and Manufacturing Company of St. Paul, Minn. The non-patterned assembly may then be cut into any desired shape and mounted with one or more other such cut assembly shapes by any suitable method to a suitable support disk or substrate, thereby producing a rotary brush assembly with the desired filament alignment and beating a desired treatment surface pattern of filaments. Alternately, the non-patterned assembly may be maintained as a single unit, and fibers may be removed by any conventional milling or sheafing operation to produce an article with the desired pattern.

The rotary brush assembly of the present invention, when constructed using one of the methods described above, produces a brush assembly with several advantages. The segmented treatment surface results in a brush assembly which requires less material than brush assemblies with a completely filled treatment surface while providing comparable treatment efficiencies when treating uneven surfaces. The more efficient use of material in constructing the brush assembly of the present invention results in decreased material costs for the brush assembly and a lower cost to the user. The use of less material also contributes to a brush assembly which weighs less than other typically available brush assemblies. The flat shape of the brush assembly permits easy storage.

The preferred construction of the brush assembly of the present invention also allows the elimination of a rigid and heavy support base for the brush assembly. Previous brush assemblies, as seen in FIGS. 1–2, require a relatively rigid and heavy support base for attachment of the brush fibers. These support bases make replacing or changing brush assemblies difficult for the user, and are not easily transported or stored. However, the brush assembly of present invention provides a flexible resin backing in which the fibers are secured, as depicted in FIGS. 3–5, which is relatively thin and light weight. The preferred construction of the brush assembly also results in a brush assembly which is relatively flat. The relatively flat shape of the brush assembly together with the light weight of the preferred brush assembly allows multiple brush assemblies to be easily stacked and stored in a convenient manner without requiting a large amount of space.

When the brush assembly of the present assembly is provided with one material of a hook and loop type fastening system 44 as illustrated in FIGS. 3 and 5, individual brush assemblies are easily interchanged on a rotary brush machine. Use of a hook and loop type fastening system, or similar attachment means, greatly increases the ease of use for the user, while providing suitable holding strength for the brush assembly. Only a single mounting surface (with the properly mating hook or loop type material located on the mounting surface and brush assembly) needs to be provided on the rotary brush machine to allow a quick and easy exchange of brush assemblies.

The following examples are provided to illustrate presently contemplated preferred embodiments of the invention, but are not intended to be limiting thereof.

TEST PROCEDURES

Experimental Examples

Experimental brush assemblies were formed by the placement of fibers into a flexible resin backing. Experimental Example 1 was formed with 22 rail diameter, grade 320 abrasive fibers (sold under the trade designation Tynex A, available from E.I. du Pont de Nemours & Company, of Wilmington, Del.) into a urethane backing. The urethane backing was composed of 92.2 pounds/100 pounds of Vibrathane 895, available from Uniroyal Chemical Company, Inc. of Middleberry, Conn., and 7.8 pounds/100 pounds of a curative and catalyst prepared by Minnesota Mining and Manufacturing Company of St. Paul, Minn. The curative and catalyst was composed of the following elements: 98.55 pounds/100 pounds of 1,4-butane-diol, available from International Specialty Products of Wayne, N.J.; 1.00 pound/100 pounds of ortho-diethyl bisaniline available from Minnesota Mining and Manufacturing Company of Cordova, Ill.; 0.25 pounds/100 pounds of Sandoz black dye RLS Savinyl, available from Sandoz Chemical Corporation of Charlotte, N.C.; and 0.20 pounds/100 pounds of DABCO-33LV (triethylene aliamine) available from Air Products and Chemicals Inc. of Allentown, Pa. This urethane backing was applied to a nylon loop cloth (Hardwick style 6615) in a depth of 5/32 inches.

The abrasive fibers were cut to a length of 11/8 inches and inserted vertically ⅛ inch into the urethane backing to produce a brush with a 1 inch trim length. The fibers were placed into the resin to form a radial pattern of 24 brush segments and correspondingly 48 "edges" 43. These segments were spaced around a 17 inch diameter circle to form alternating fiber filled areas and open areas in the ratio 2:1. The individual brush segments are generally trapezoidal in shape, and they extend from the brush circumference inches inward in the radial direction and are approximately inches in width at the brush circumference. The spacing between the fiber filled segments is approximately ¾ inch at the brush circumference. The fiber density within the fiber segments is approximately 3.2 grams per square inch.

The fibers were held in the vertical position while the urethane elastomer was cured for 24 minutes utilizing a step cure of 240° F. for 12 minutes followed by 280° F. for an additional 12 minutes. After cooling, the fiber-/elastomer assembly was cut to a final circular shape utilizing a 17 inch outside diameter by inches inside diameter die rule.

Figure 6:
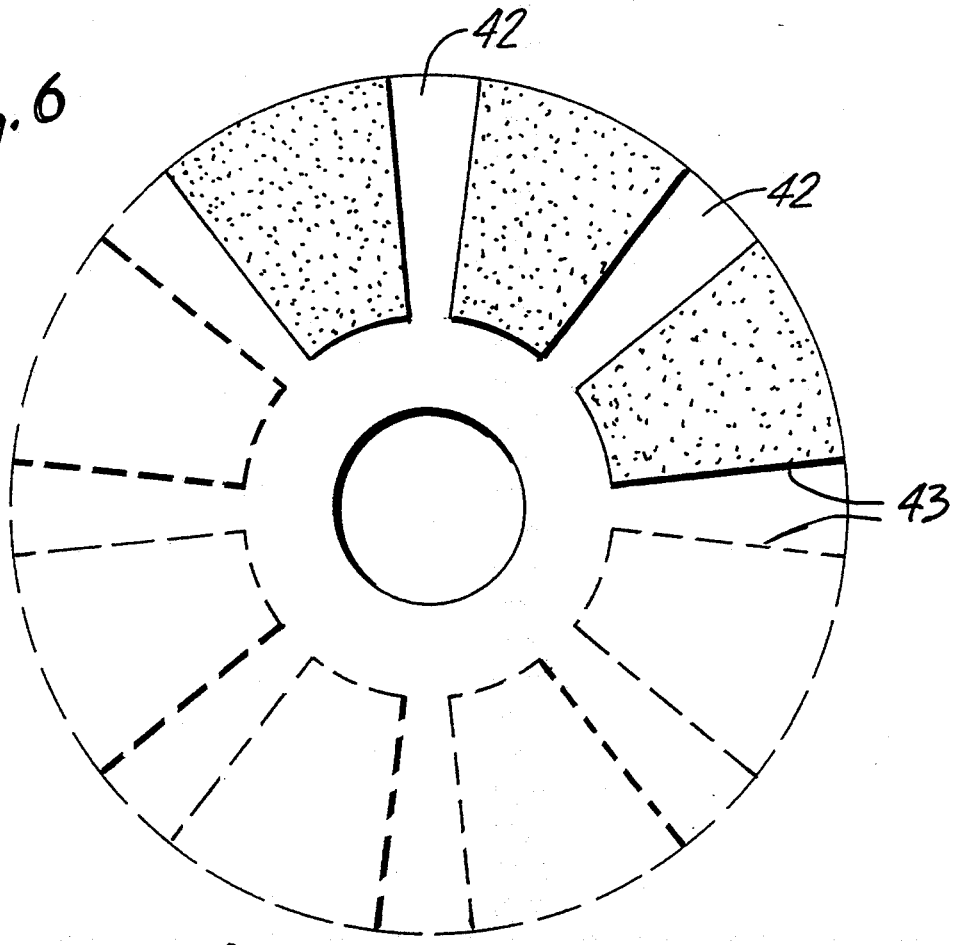
FIG. 6 is a bottom elevational view of the brush assembly of the present invention illustrating an alternative bristle pattern.

The method described above for creating the rotary brush assembly of Experimental Example 1 was also utilized in the preparation of Experimental Examples 2–8. These examples differ from Experimental Example 1 by changing one or more of the following variables: fiber trim length, fiber grade, or fiber pattern geometry. The fiber grade designates size of the abrasive particles in a particular fiber, with the grade number decreasing as the size of the abrasive particles increases. The grade of the fibers used varies depending upon the desired surface treatment. When no pattern was produced, the fibers were placed in 100% of the annular treatment surface area thereby producing a "ring shaped" treatment surface, with no "edges" 43. Table 1 contains a summary of the parameters for each of Experimental Examples 1–8. It should be noted that Experimental Examples 4 and 6 had the same pattern geometry as Experimental Example 1. The pattern geometry of Experimental Example 7, illustrated in FIG. 6, contained eight truncated wedge-shaped fiber filled sections where the radial length of each wedge-shaped section was inches and the distance across each fiber wedge at the brush circumference was inches. These were spaced at equal distances around the brush perimeter, thereby defining 16 radially-extending edges 43. The pattern geometry of Experimental Example 8, illustrated in FIG. 7, was a brush segment element similar to Experimental Example 1, with the segment outside diameter swept approximately 22° in the clockwise direction to form a swirl pattern. The brush of Experimental Example 8 had twenty-three fiber-filled sections, thus defining forty-six "edges" of such sections. As shown, each edge defines a segment of a spiral across the treatment surface of the brush.

TABLE 1

| EXPERIMENTAL EXAMPLE NO. | FIBER GRADE | FIBER TRIM | PATTERN | PATTERN GEOMETRY |
|---|---|---|---|---|
| 1 | 320 | 1" | Yes | 24 |
| 2 | 320 | 1" | No | full face |
| 3 | 320 | 1⅛" | No | full face |
| 4 | 320 | 1⅛" | Yes | 24 |
| 5 | 120 | 1" | No | full face |
| 6 | 120 | 1" | Yes | 24 |
| 7 | 320 | 1⅛" | Yes | 8 |
| 8 | 320 | 1⅛" | Yes | 23 |

Experimental Examples 9–15

Experimental Examples 9–15 were formed from brush segments as described in Experimental Example 1. Varying numbers of the fiber filled segments were spaced equidistant at the circumference of the support disk to vary the open areas between the adjacent fiber segments and to vary the number of edges. Performance testing was conducted to evaluate the cleaning efficiency of each brush assembly and to assess how smoothly the brush assembly would run (i.e., whether the brush assembly would produce undesirable "bounce" as it rotated) when the spacing between the fiber filled segments at the circumference of the brush assembly was adjusted from no spacing (i.e., a completely filled brush face) to 4.5 inches (a ratio of filled space to open space of 0.33:1). Table 2 contains the parameters and test results for Experimental Examples 9–15.

TABLE 2

| EXPERIMENTAL EXAMPLE NO. | NO. FIBER SEGMENTS | FIBER-FILL: OPEN RATIO | BRUSH BOUNCE | % CLEAN 1 PASS |
|---|---|---|---|---|
| 2 | full face | NA | No | 50 |
| 9 | 31 | 6:1 | No | 70 |
| 10 | 27 | 3:1 | No | 70 |
| 11 | 24 | 2:1 | No | 80 |
| 12 | 18 | 1:1 | No | 80 |
| 13 | 15 | 0.75:1 | Slight | 85 |
| 14 | 12 | 0.50:1 | Yes | 80 |
| 15 | 9 | 0.33:1 | Yes | 75 |

The test results summarized in Table 2 indicate that the preferred ratio of fiber filled space to open space is approximately 2:1 to achieve the best cleaning efficiency while at the same time minimizing undesirable brush bounce. It should be noted that brush assemblies of diameters other than that tested (17 inches) may be constructed. As the diameter of the brush assemblies change, the number of fiber filled segments on brush assemblies is adjusted to achieve the preferred 2:1 ratio of fiber filled space to open space at the brush assembly circumference. Table 3 lists the number of discrete brush segments on the face of the brush which are required to achieve the preferred ratio of 2:1 for each diameter of brush assembly from 12 inches to 20 inches, inclusive.

TABLE 3

| | | | | | | | | | |
|---|---|---|---|---|---|---|---|---|---|
| BRUSH DIAMETER (INCHES) | 12 | 13 | 14 | 15 | 16 | 17 | 18 | 19 | 20 |
| NO. OF SEGMENTS ON BRUSH FACE | 17 | 18 | 20 | 21 | 23 | 24 | 25 | 27 | 28 |

Test Equipment

The treatment efficiency of each of the rotary brush assemblies listed in these examples was determined by coating an area of flooring material with a mixture of latex paint and drywall joint compound, allowing the coating to dry, and then passing a rotary floor machine utilizing various test brushes over the surface. The test floor surface utilized Norament rubber floorway available from Freudenberg Building Systems, Inc., of Lawrence, Mass. The floor surface contained one inch raised circular areas which provided an uneven floor surface. The coating material was composed of, by volume, two parts semi-gloss latex wall and trim enamel paint, one part flat latex wall paint, and three parts drywall joint compound. The paint components are manufactured by Glidden Company, of Cleveland, Ohio. The drywall joint compound is manufactured by Welco Manufacturing Company, of Kansas City, Mo. A Clark 17-inch 175 rpm rotary floor machine, manufactured by Clark Industries, Inc. of St. Louis, Mo., was used for the tests.

Treatment Efficiency Test Procedure

The test procedure for determining treatment efficiency was as follows:

1. The Norament rubber floor was coated with approximately 25 grams of the above described test coating mixture to form an approximately 7-inch by 28-inch coated strip on the surface. The mixture was spread evenly with a paint brush and allowed to air dry for 24 hours.

2. The brush assembly to be tested was placed on a 17-inch Clark rotary floor machine with a rotation speed of 175 rpm.

3. The Norament rubber floor was flooded with water for 5 seconds at a flow rate of 1 gallon per minute.

4. The rotary floor machine and attached brush assembly were passed once over the floor test section. A "pass" is defined as a complete traverse across the floor section and back to the original starting position thereby coveting the test section twice.

5. The floor test section was hosed off with water and visually inspected to determine the percent of the coating material which had been removed. For example, a rating of 75% would mean that 75% of the test coating was removed in the traversed area.

6. Two additional passes over the test section were completed, and a visual inspection was conducted again after the completion of the final pass.

Test results for 17-inch diameter brushes are shown in Table 4.

TABLE 4

| BRUSH TYPE | PATTERNED (1) | % CLEAN 1 PASS | % CLEAN 3 PASSES |
|---|---|---|---|
| Experimental Example 1 | Yes | 83 | 93 |
| Experimental Example 2 | No | 50 | 63 |
| Experimental Example 3 | No | 58 | 78 |
| Experimental Example 4 | Yes | 88 | 97 |
| Experimental Example 5 | No | 65 | 80 |
| Experimental Example 6 | Yes | 80 | 98 |
| Flo-Pac Scrub Grit II | No | 90 | 100 |
| Flo-Pac Scrub Grit II | Yes | 93 | 100 |
| Trimmed Flo-Pac Nylo-Grit (2) | No | 50 | 50 |
| Trimmed Flo-Pac Nylo-Grit (2) | Yes | 65 | 85 |
| Rubbermaid Heavy Duty Scrub | No | 90 | 98 |
| Rubbermaid Heavy Duty Scrub | Yes | 90 | 95 |

Note (1) The brushes denoted as "patterned" were made such that the brush assembly treatment surface area filled to open ratio was approximately 2:1, with the fiber filled segments extending radially from the center of the brush assembly toward the circumference of the brush assembly as depicted in FIG. 4. The patterned Rubbermaid brush (manufactured by Rubbermaid Commercial Products of Winchester, Virginia) and the patterned Flo-Pac brush (manufactured by Flo-Pac Corporation of Minneapolis, Minnesota) were prepared by removing bristle clusters from the backing of each brush until the remaining bristles were generally in the same pattern shapes as those on the patterned brushes of the present invention (FIG. 4). The rotary brush assembly of the present invention contained 24 fiber filled segments, the Flo-Pac patterned brush contained 22 bristle segments, and the Rubbermaid patterned brushes contained 25 bristle segments.

Note (2) The trimmed Flo-Pac brushes were sheared to obtain a trim length of one inch. The original Flo-Pac brush had a trim length of 1½ inch.

Although the present invention has been described with reference to preferred embodiments, workers skilled in the art will recognize that changes may be made in form and detail without departing from the spirit and scope of the invention.

What is claimed is:

1. A rotary brush assembly for use with a surface treatment machine for treating a surface, the rotary brush comprising:

a circular disk with a central rotary axis, the disk having a generally flat first side and a second side;

a plurality of elongated fibers, the fibers individually attached to the first side of the disk, the fibers generally Closely spaced and parallel to one another and having unattached ends which collectively define a generally planar treatment surface adjacent and generally parallel to the first side of the disk, the closely Spaced and parallel arrangement of the fibers causing the fibers to resist bending and causing the unattached ends of the fibers to remain in contact with the surface to be treated, the fibers arranged to define a plurality of spaced apart segments on the generally planar treatment surface wherein each segment is wedge-shaped and has a periphery which, in part, includes at least two edges radially aligned for encountering recessed areas in a surface to be treated.

2. The rotary brush of claim 1, wherein the disk includes connection means for connecting the brush to a surface treatment machine.

3. The rotary brush of claim 2, wherein the connection means utilize a hook and loop type fastener, with one material of the hook and loop type fastener attached to the second side of the disk, and the mating material of the hook and loop type fastener adapted for attachment to a mounting surface which is secured to a surface treatment machine.

4. The rotary of claim 1, wherein the disk is flexible.

5. A brush for use with a floor maintenance machine, the brush comprising:

a circular plate with a central rotary axis, the plate having a first side and a second side;

a plurality of fibers each having a first end and a second end, the first ends of the fibers individually attached to the first side of the plate, the fibers closely spaced to each other and aligned generally parallel to the central rotary axis, the close spacing of adjacent fibers inhibiting bending of individual fibers and maintaining the parallel alignment of the fibers with the central rotary axis, the fibers positioned such that the second ends of the fibers define a generally planar treatment surface adjacent and generally parallel to the first side of the disk, the second ends of the fibers defining a plurality of spaced apart Wedge-shaped segments, each segment having a periphery which, in part, includes at least two edges radially aligned for accessing recessed portions of an uneven surface.

6. The brush of claim 5, wherein the brush includes mounting means on the second side of the plate for mounting the brush to the floor machine.

7. The brush of claim 6, wherein the mounting means utilizes the mating materials of a hook and loop type fastener.

8. The brush of claim 5, wherein the plate is flexible.

9. A rotary brush comprising:

a circular disk having a first side and a second side;

a plurality of elongated fibers individually attached to the first side of the disk, the fibers closely .spaced and generally parallel to one another and perpendicular to the first side of the disk, the close spacing between the individual fibers inhibiting bending of the fibers and maintaining the second ends of the fibers in contact with a surface to be treated, the second ends of the fibers defining a segmented treatment surface wherein the segmented treatment surface forms spaced apart wedge-shaped segments of fibers, the wedge-shaped segments having a periphery which, in part, includes a radial leading edge and a radial trailing edge for accessing recessed portions of an uneven surface to be treated.

10. A rotary brush assembly for treating an uneven surface, the rotary brush assembly comprising:

a circular disk having a generally flat first side and a second side; and a plurality of elongated fibers, each fiber having a first end and a second end, the first end of each fiber being individually attached to the first side of the disk, the fibers generally parallel to one another and perpendicular to the first side of the disk, the second ends of the fibers collectively defining a treatment surface, the treatment surface adjacent and generally parallel to the first side of the disk, the fibers closely spaced such that adjacent fibers support each other to maintain the fibers generally perpendicular to the first side of the disk and to maintain the second ends of the fibers in contact with the surface to be treated, the fibers positioned such that the second ends of the fibers form wedge-shaped areas of filled space on the treatment surface, the areas of filled space separated by open areas on the treatment surface, the wedge-shaped segments each having a periphery which, in part, includes at least two radially aligned edges for encountering recessed areas in a surface to be treated.

11. The rotary brush of claim 10, wherein the treatment surface provides a ratio of filled space to open space in the range of 6:1 to 0.5: 1.

12. The rotary brush of claim 11, wherein the ratio of filled space to open space is 2:1.

13. The rotary brush of claim 10, wherein the disk includes connection means for attaching the brush to a rotary brush machine.

14. The rotary brush of claim 13, wherein the connection means utilizes a hook and loop type fastener, with one material of the hook and loop type fastener attached to the second side of the disk, and the mating material of the hook and loop type fastener adapted for attachment to a mounting surface which is secured to the rotary brush machine.

15. The rotary brush of claim 10, wherein the fibers include abrasive particles.

16. A rotary brush assembly for use with a surface treatment machine for treating a surface, the rotary brush comprising:

a circular disk with a central rotary axis, the disk having a generally flat first side and a second side;

a plurality of elongated fibers, the fibers individually attached to the first side of the disk, the fibers generally closely spaced and parallel to one another and having unattached ends which collectively define a generally planar treatment surface adjacent and generally parallel to the first side of the disk, the closely spaced and parallel arrangement of the fibers causing the fibers to resist bending and causing the unattached ends of the fibers to remain in contact with the surface to be treated, the fibers arranged to define a plurality of spaced apart segments on the generally planar treatment surface wherein each segment has a periphery which, in part, includes an edge aligned spirally along the first side of the disk for encountering recessed areas in a surface to be treated.

17. A rotary brush assembly for use with a surface treatment machine for treating a surface, the rotary brush comprising:

a monolithic circular disk with a central rotary axis, the disk formed of a polymeric material and having a generally flat first side and a second side;

a plurality of elongated fibers, the fibers individually embedded in the first side of the monolithic polymeric disk, the fibers generally closely spaced and parallel to one another and having unattached ends which collectively define a generally planar treatment surface adjacent and generally parallel to the first side of the disk, the closely spaced and parallel arrangement of the fibers causing the fibers to resist bending and causing the unattached ends of the fibers to remain in contact with the surface to be treated, the fibers arranged to define a plurality of spaced apart segments on the generally planar treatment surface wherein each segment is wedge-shaped and has a periphery which, in part, includes at least two edges radially aligned for encountering recessed areas in a surface to be treated.

* * * * *

UNITED STATES PATENT AND TRADEMARK OFFICE

CERTIFICATE OF CORRECTION

PATENT NO. : 5,438,728

DATED : August 8, 1995

INVENTOR(S) : MICHAEL J. KUBES, LAWRENCE J. MANN, JONATHAN E. NOBLE

It is certified that error appears in the above-indentified patent and that said Letters Patent is hereby corrected as shown below:

Col. 2, line 22, delete "fiat", and insert --flat--

Col. 7, line 37, delete "sheaf-", and insert --shear- --

Col. 8, line 3, delete "requiting", and insert --requiring--

Col. 8, line 26, delete "rail" and insert --mil--

Col. 8, line 45, delete "aliamine", and insert --diamine--

Col. 8, line 58, insert --3 3/4-- before inches

Col. 8, line 59, insert --1 1/2-- before inches

Col. 9, line 1, insert --3 3/8-- before inches

Col. 9, line 24, insert --3 3/4-- before inches

Col. 9, line 25, insert --5 1/4-- before inches

Col. 11, line 69, delete "Closley", and insrt --closely--

Col. 12, line 4, delete "Spaced", and insert --spaced--

Col. 12, line 41, delete "Wedge-shaped", and insert --wedge-shaped--

UNITED STATES PATENT AND TRADEMARK OFFICE

CERTIFICATE OF CORRECTION

PATENT NO. : 5,438,728

DATED : August 8, 1995

INVENTOR(S) : Michael J. Kubes, et al

It is certified that error appears in the above-indentified patent and that said Letters Patent is hereby corrected as shown below:

Col. 12, line 54, delete "." before spaced

Signed and Sealed this

Twelfth Day of December, 1995

*Attest:*

*Attesting Officer*

BRUCE LEHMAN

*Commissioner of Patents and Trademarks*